US006967056B2

(12) United States Patent
Kashino

(10) Patent No.: US 6,967,056 B2
(45) **Date of Patent: *Nov. 22, 2005**

(54) KEY SHEET

(75) Inventor: Masayuki Kashino, Iwatsuki (JP)

(73) Assignee: Polymatech Co., Ltd., Tokyo ( * ) Notice: Subject to any disclaimer, the term of this patent is extended or adjusted under 35 U.S.C. 154(b) by 154 days.

This patent is subject to a terminal disclaimer.

(21) Appl. No.: 10/303,338

(22) Filed: Nov. 25, 2002

(65) Prior Publication Data

US 2003/0108720 A1 Jun. 12, 2003

(30) Foreign Application Priority Data

Nov. 28, 2001 (JP) ..... 2001-362808
Nov. 29, 2001 (JP) ..... 2001-364636

(51) Int. Cl.[7] ..... B32B 3/00

(52) U.S. Cl. ..... 428/189; 200/341; 200/310; 200/314; 200/512; 200/513; 200/516; 200/517; 400/490; 400/491; 400/492; 400/493; 400/494; 400/495

(58) Field of Search ..... 428/189, 131, 428/134, 137, 138; 200/342, 343, 513, 345, 200/516, 517, 341, 344, 302.2, 520, 512, 200/521; 400/490–498; 414/909; 379/441, 379/456, 156, 433, 362, 364, 368, 369, 370, 379/433.06, 433.07; D14/320, 338, 340, D14/142, 148, 150, 151, 399; D18/6, 7, 12.2

(56) References Cited

U.S. PATENT DOCUMENTS

| | | | | |
|---|---|---|---|---|
| 5,681,515 | A * | 10/1997 | Pratt et al. | 264/153 |
| 5,911,317 | A * | 6/1999 | Tsai | 200/514 |
| 6,111,324 | A * | 8/2000 | Sheppard et al. | 257/787 |
| 6,284,569 | B1 * | 9/2001 | Sheppard et al. | 438/110 |
| 6,322,875 | B1 * | 11/2001 | Kimura | 428/195.1 |
| 6,382,855 | B1 * | 5/2002 | Katori | 400/494 |
| 6,713,698 | B2 * | 3/2004 | Kashino | 200/341 |
| 2001/0051254 | A1 * | 12/2001 | Katori et al. | 428/189 |

FOREIGN PATENT DOCUMENTS

| | | | |
|---|---|---|---|
| EP | 1316978 A1 * | 6/2003 | H01H 13/70 |
| JP | 8-7698 | 1/1996 | H01H 13/14 |
| JP | 8-156020 | 6/1996 | B29C 24/14 |

* cited by examiner

*Primary Examiner*—Harold Pyon
*Assistant Examiner*—Patricia L. Nordmeyer
(74) *Attorney, Agent, or Firm*—Fish & Richardson P.C.

(57) ABSTRACT

A key sheet comprising a key top, a translucent resin film, and a symbol layer. The key top is made of resin and has a top surface and a rear surface. The key top includes a gate corresponding section in a position corresponded to a gate of a mold for injecting resin to form the key top. The translucent resin film is provided over the key top. The symbol layer is disposed to associate with the top surface of the key top. The gate corresponding section is located to prevent that gate corresponding section from being viewed through the symbol layer.

21 Claims, 6 Drawing Sheets

KEY SHEET

CROSS REFERENCE TO RELATED APPLICATIONS

Pursuant to 35 USC § 119, this application claims the benefit of Japan Patent Application No. 2001-362808, filed Nov. 28, 2001 and Japan Patent Application 2001-364636, filed Nov. 29, 2001.

BACKGROUND OF THE INVENTION

The present invention relates to a key sheet applied for a push button switches in various electronic appliances, such as information communication devices including portable telephones, automobile telephones, and audio devices.

Various electronic appliances, including mobile communication terminals such as portable telephones and automobile telephones, are required to have smaller weight, size, and thickness. Accordingly, the push button switches used in such devices are also required to have smaller size. In order to meet the above requirements, key sheets are known in the art having key tops comprising a translucent resin and a translucent resin film adhered to all the surfaces of the key tops, except for the rear surface. This kind of key sheets have been widely adopted recently.

FIG. 15 is a cross-sectional view of a conventional key sheet. A key sheet 31 comprises a key top 33, comprising a translucent resin, and a translucent resin film 32 adhered to an outer surfaces of the key top, except on its rear surface, so that one or more convex-shaped press button 34 is formed on its upper surface. A symbol layer 35 is formed on a rear surface 32*a* of the translucent resin film 32 to display a graphical symbol (such as characters, symbols, numbers, and patterns) on the press button 34. A graphical symbol is attached to the symbol layer 35 through printing or the like. A conventional key top 33 included a gate corresponding section 36*a*, which corresponds to a gate used for injection of resin in a substantially center position of a rear surface 33*a*. The key sheet 31 is typically manufactured by first curving a translucent resin film 32 to have a shape corresponded to a profile of the key top 33 and then injecting molded resin in the curved portion.

Recently there are needs for performing various designs on key sheets of this kind. For instance, there are needs for providing various designs to key sheets used for push button switches of portable telephones. Accordingly, key sheets are required in which graphical symbols displayed on the key sheets are easily recognized while the key sheets have high quality designs.

However, a gate corresponding section 36*a* is disposed at a position corresponded to a gate of a mold for injecting resin. Since the gate corresponding section is disposed in almost the center of the rear surface 33*a* of the key top 33 in conventional key sheets 31, the gate corresponding section 36*a* was visible when a key top 33 was viewed from the top surface of the press button 34. Accordingly, the conventional key sheets 31 described above were inferior in their designs. Specifically, the graphics of the symbol layer 35 were deformed because of the existence of the gate corresponding section 36*a*, in the case where the symbol layer 35 is formed on the rear surface 32*a* of the translucent resin film. In this way, visibility of the press button 34 of the key sheet 31 was reduced because the gate corresponding section 36*a* inhibited the viewers from easily viewing the symbol layer 35.

In order to solve the problems described above, attempts were made to provide the gate corresponding section 36*a* on a periphery of the key top 33, as shown by reference numeral 36*b* in FIG. 15. However, the gate corresponding section 36*a* was still visible from the upper surface of the press button 34 of the sheet when the gate corresponding section 36*a* was merely moved to an edge of the conventional key sheet structure.

On the other hand, Japanese Laid-Open Patent Publication 8-7698 discloses a key sheet 41, as shown in FIG. 16, in which a gate corresponding section 46*a* is disposed to project outwardly from a side face of a projection of a key top 43.

However, a thin key sheet 41 cannot be realized when the key top 43 was further projected from the lowermost surface of the translucent resin film 42 because the key top 43 was thicker by a thickness L of the projection 43*a*. Further, it was difficult to fill a molten thermoplastic resin in a cavity of a mold, when manufacturing the key top 43 of the above shape. A so-called short shot, an air pocket, and so forth were easily formed in this method.

BRIEF SUMMARY OF THE INVENTION

The present invention solves the above problems. An object of the invention is to provide a key sheet with a high quality design, which has a small size and a light weight, with high quality visibility.

In order to achieve the above objectives, the present invention provides a key sheet comprising:

a key top made of resin, said key top having a top surface and a rear surface, and said key top including a gate corresponding section in a position corresponded to a gate of a mold for injecting resin to form the key top;

a translucent resin film provided over the key top; and a symbol layer disposed to associate with the top surface of the key top, wherein said gate corresponding section is located to prevent the gate corresponding section from being viewed through the symbol layer.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments, together with the accompanying drawings in which.

DETAILED DESCRIPTION OF THE PREFERRED EMBODIMENTS

The first embodiment of the invention is described by referring FIGS. 1 to 5.

Figure 1:
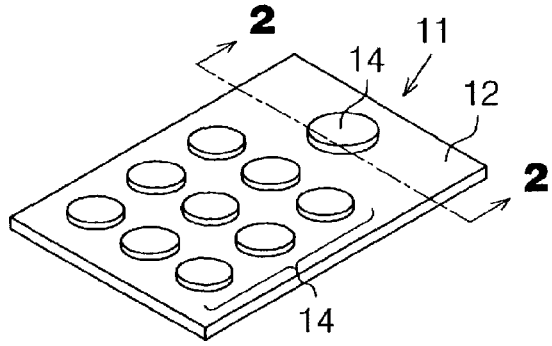
FIG. 1 is a perspective view of a key sheet according to the first embodiment of the invention.
Figure 2:
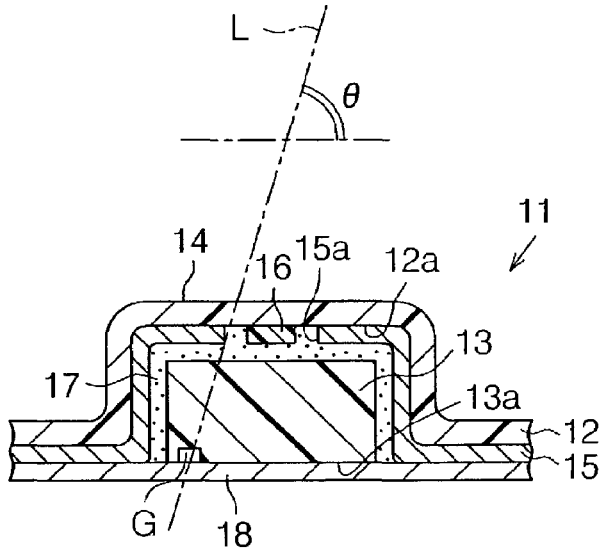
FIG. 2 is a cross sectional view taken along a line 2—2 in FIG. 1.

A plurality of press buttons 14, which project on an upper surface of a key sheet 11, is shown in FIG. 1. The key sheet 11 comprises a translucent resin film 12 and a plurality of key tops 13 having a substantially cylinder shape and comprising a translucent resin. A portion of the translucent resin film 12 is curved to fit along a surface of the resin key top 13 so that the translucent resin film 12 is adhered to surfaces except a rear surface 13*a* of the key top 13.

The translucent resin film 12 may be comprised of any resin having translucency without limitation to the compositions, kinds, and colors. The material can be appropriately selected from among known flexible resins in compliance with required performance.

More specifically, examples of the translucent resin film 12 may include olefin films, vinyl films, fluoride films, polycarbonate films, acetate films, polyester films, polyamide films, polyimide films, and ionomer films. Among these, polycarbonate films, fluoride films, and polyester films having superior translucency are preferred.

A first decorating layer 15 is disposed adjacent to a rear surface 12*a* of the translucent resin film 12. The first decorating layer 15 is selectively disposed on only portions of the rear surface 12*a* of the translucent resin film 12. An opening 15*a* is disposed practically in the center of a press button 14.

The first decorating layer 15 may have any colors (including red, blue, yellow, green, white, black, and gray, etc.) or it may have a metallic luster. The first decorating layer 15 is visible through the translucent resin film 12 from upper surface of the press button 14. The first decorating layer 15 is formed by applying, printing, or transferring ink or a coating, or, evaporating or transferring inorganic substance onto the rear surface 12*a* of the translucent resin film 12. Note that the first decorating layer 15 may display any graphical symbols including letters, numbers, symbols, and patterns.

The opening 15*a* may be provided by forming the first decorating layer 15 on portions of the rear surface 12*a* of the translucent resin film 12. Alternatively, the opening 15*a* may be disposed by first forming the first decorating layer 15 entirely on the rear surface 12*a* of the translucent resin film 12, and then removing portions of the first decorating layer 15 by etching, etc.

A symbol layer 16 is disposed practically in the center of the opening 15*a*. The symbol layer 16 displays graphical symbols including letters, numbers, symbols, and patterns to be visible from the top of the press button 14 through the translucent resin film 12. The symbol layer 16 is formed by, for instance, applying, printing or transferring ink or coating on the rear surface 12*a* of the translucent resin film 12 within the opening 15*a*. The symbol layer 16 may have an inked-up display, or it may have a cut-out display. The symbol layer 16 may be formed on either a top surface or the rear surface, or both the top and rear surfaces of the translucent resin film 12.

A transparent reinforcing layer 17 is disposed on a rear side of the first decorating layer 15 and the symbol layer 16. The reinforcing layer 17 is formed by, for instance, applying or printing a transparent resin film on a rear side of the first decorating layer 15 and the symbol layer 16. The reinforcing layer 17 suppresses distortion, deformation, and degradation of the first decorating layer 15 and the symbol layer 16 while they go through a process step of curving the translucent resin film 12 and a process step of injection forming the key top 13. The appearance and the quality of the first decorating layer 15 and the symbol layer 16 are retained by suppressing distortion, deformation, or degradation. The reinforcing layer 17 further improves adhesiveness between the translucent resin film 12 and the key top 13.

A synthetic resin used for the key top 13 is not limited to specific compositions, kinds, or colors so long as it has translucency. The resin may be appropriately selected to conform to required performance among known synthetic resins including thermoplastic resins, thermoplastic elastomers, hardened resins, or cross-linked rubbers. Preferred are thermoplastic resins, which are convenient for fabrication. Preferable materials that can be used include: polycarbonate resins, polyester resins, fluoride resins, acrylic resins, acrylonitrile butadiene stylene resin (ABS resin), acrylonitrile stylene resin, and acrylonitrile-chlorinated polyethylen-stylene resin. Specifically preferred is polycarbonate resin, which is superior in transparency, mechanical strength and heat resistance, etc.

A gate corresponding section G, which corresponds to a gate for injecting resin in the mold, is provided on a rear surface 13*a* of the key top 13. The gate corresponding section G is disposed under the first decorating layer 15 and in the proximity of peripheral edge of the rear surface 13*a* of the key top 13, to avoid underneath of the opening 15*a*. More specifically, the gate corresponding section G is disposed at a position at which a depression angle θ shown in FIG. 2, namely an angle formed by a horizontal line and a line L extending between an edge of the opening and the gate corresponding section, is 60 degrees or less. Accordingly, the rear surface 13*a* of the key top 13 has a smooth surface without any step under the opening 15*a* disposed practically in the center of the press button 14. In this way, high quality letters and decorations can be easily disposed in a region visible through the opening 15*a* so that the press button 14 can be designed in various ways. Therefore, the key sheet 11 is realized with superior appearance.

A second decorating layer 18 is provided on the rear surface 13*a* of the key top 13. The second decorating layer 18 may have any colors (including red, blue, yellow, green, white, black, and gray, etc.) or it may have a metallic luster.

The second decorating layer 18 is visible through the translucent resin film 12 from upper surface of the press button 14. The second decorating layer 18 is formed by methods similar to that of the first decorating layer 15. The second decorating layer 18 may display any graphical symbols including letters, numbers, symbols, and patterns. The gate corresponding section G is disposed under the first decorating layer 15 and in proximity of the peripheral edge of the rear surface 13*a* of the key top 13 so that the gate corresponding section G is prevented from being recognized in the key sheet 11 according to the first embodiment. Therefore, the second decorating layer 18 will not be blurred by the gate corresponding section G. In this way, the key sheet 11 is realized with superior appearance. The key sheet 11 is further designed in various ways by disposing the second decorating layer 18 as described above.

The first decorating layer 15 and the second decorating layer 18 preferably have a metallic luster. The first and the second decorating layers 15 and 18 having such metallic luster can be formed by applying or printing an ink including metallic power (metal ink), or evaporating or transferring metals such as aluminum, chromium, copper, and nickel. Designs with metallic luster can be realized by providing metallic luster to the first and the second decorating layers 15 and 18.

Preferably, the first and the second decorating layers 15 and 18 have translucency. The first and the second decorating layers 15 and 18 can be formed with translucency by applying or printing an ink or a coating having translucency, or by evaporating a metal such as aluminum, chromium, copper, and nickel into a thickness between 2 to 399 nm. In the case where the first and the second decorating layers 15 and 18 are formed with translucency, the visibility of the key sheet 11 at night and in the dark places can be improved by disposing an illuminant, such as light emitting diode (LED) and electroluminescence (EL), on the rear surface 13*a* of the key top 13. By evaporating a metal such as aluminum, chromium, copper, and nickel into a thickness between 5 to 50 nm, the first and the second decorating layers 15 and 18 can be realized with both metallic luster and translucency.

As described above, the gate corresponding section G is invisible due to the first decorating layer 15 in the key sheet 11 of the first embodiment, when the key top 13 is observed from the upper surface of the press button 14. In other words, the first decorating layer 15 has a function to shield the gate corresponding section G from the field of view. Accordingly, the key sheet 11 can be realized with good appearance.

The first decorating layer 15 is disposed on the rear surface 12*a* of the translucent resin film 12, the graphic symbol layer 16 is disposed in the opening 15*a*, and the second decorating layer 18 is disposed on the rear surface 13*a* of the key top 13 in the first embodiment. By thus forming the press button 14, the first and the second decorating layers 15 and 18 are visible in the periphery of the symbol layer 16 and the symbol layer 16 is visualized as a three-dimensionally projected appearance in which a shade of the graphics in the symbol layer 16 are projected on the second decorating layer 18. A new design, which was not conventionally possible can be realized by forming a three-dimensionally recognized symbol layer 16, so that a key sheet 11 can be realized with a good appearance.

Figure 3:
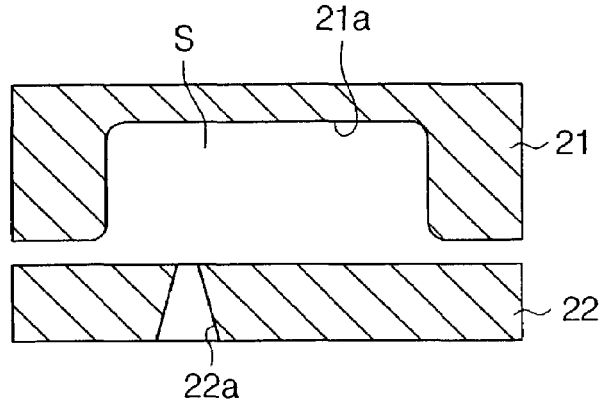
FIG. 3 is a cross sectional view of a mold used for manufacture of a key top of the invention.
Figure 4:
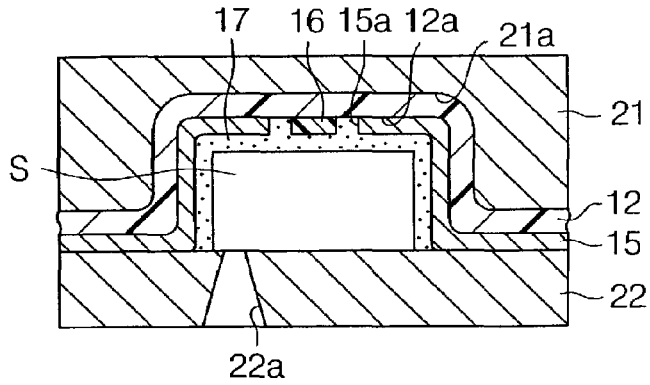
FIG. 4 is a partial cross sectional view showing one process step of a process for manufacturing a key sheet of the invention.
Figure 5:
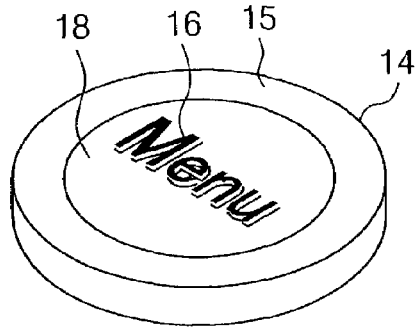
FIG. 5 is a perspective view of a press button of a key sheet according to the invention.

A method for forming the key sheet 11 according to the first embodiment is described by referring to FIGS. 3 and 4.

A method using a pair of molds (a first mold 21 and a second mold 22) for forming a key top 13 is described. A cavity S for molding a key top 13 is provided in the first mold 21 as shown in FIG. 3. The cavity S is defined by a substantially cylindrical hollow 21*a*.

A gate 22*a* for injecting a molten resin into the cavity S of the first mold 21 is provided in the second mold 22 to be offset with respect to the center of the cavity S. Since a gate corresponding section is formed to conform to the position of the gate 22*a*, the gate 22*a* is positioned at a location where a depression angle θ, an angle formed by a horizontal plane and a line L extending between an edge of the opening and the gate 22*a*, is 60 degrees or less. Examples of the gate 22*a* include a pinpoint gate, a fan gate, a film gate, a ring gate, a disk gate, a submarine gate, an overlap gate, a direct gate, a tab gate, and an edge gate. A pinpoint gate is preferable because a trace of the gate (gate corresponding section G) which remains on the key top 13 is small, though the gate is not specifically limited to this structure.

In manufacture of the key sheet 11, the first decorating layer 15 is formed on portions of the rear surface 12*a* of the translucent resin film 12, and then the symbol layer 16 is formed in the opening 15*a* of the first decorating layer 15. The transparent reinforcing layer 17 is then formed by means such as application and printing, on a side on which the first decorating layer 15 and the symbol layer 16 are formed on the translucent resin film 12.

The translucent resin film 12, on which the first decorating layer 15, the symbol layer 16, and the transparent reinforcing layer 17 are formed, is then mold clamped between the first and the second molds 21 and 22 as shown in FIG. 4. A portion of the translucent resin film 12, which is clamped between the first and the second molds 21 and 22, is preferably curved and deformed beforehand to fit with the shape of the upper surface of the key top 13 to be formed (shape of the cavity S of the first mold 21). This can be done by using a means, such as a fixture.

Molten synthetic resin is then injected into the cavity S through the gate 22*a* of the second mold 22. The translucent resin film 12 is extended to curve approximately the same shape with the cavity S of the first mold 21 in accordance with the injection of the molten synthetic resin into the cavity S. As a result, the translucent resin film 12 and the key top 13 are adhered by heat at the same time with the formation of the key top 13, and the key sheet is manufactured.

The first and the second molds 21 and 22 are detached after cool to remove the key sheet. The key sheet 11 according to the first embodiment is finished by forming the second decorating layer 18 on the rear surface 13*a* of the key top 13 of the key sheet.

Figure 6:
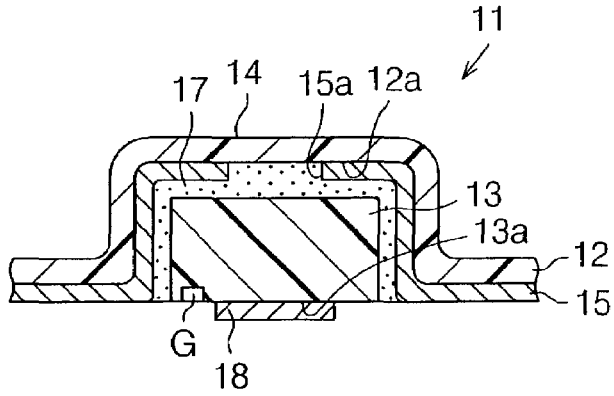
FIG. 6 is a partial cross sectional view of a key sheet according to the first embodiment of the invention.

The second decorating layer 18 may be provided in only portions of the rear surface 13*a* of the key top 13. For example, the second decorating layer 18 can be formed only underneath of the opening 15*a*, as shown in FIG. 6.

The first decorating layer 15 can be provided on the top surface of the key top 13, provided that the film is interposed between the translucent resin film 12 and the key top 13.

The graphic display region 16 and/or the transparent reinforcing layer 17 may be omitted from the key sheet 11.

The shape of the key top 13 (shape of hollow 21*a* for forming the key top 13) can be any shape, regardless the shape illustrated in the figures.

The second embodiment of the invention is described by referring to FIGS. 7 to 11.

Figure 7:
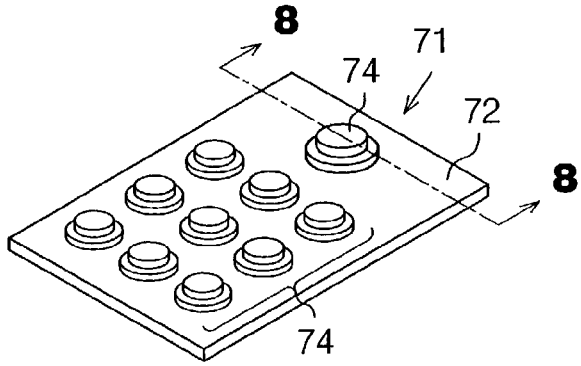
FIG. 7 is a perspective view of a key sheet according to the second embodiment of the invention.
Figure 8:
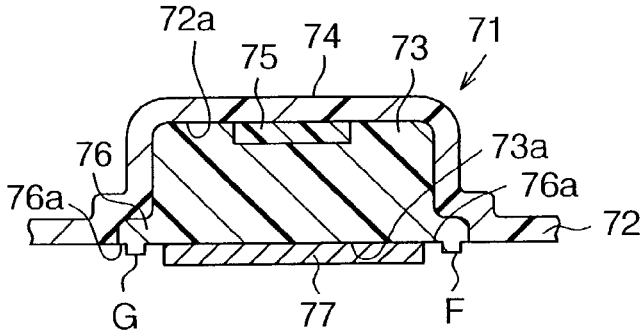
FIG. 8 is a cross sectional view taken along a line 8—8 in FIG. 7.

A plurality of press buttons 74 are shown on an upper surface of the key sheet 71 in FIG. 7, and the key sheet 71 comprises a translucent resin film 72 and a plurality of key tops 73 as shown in FIG. 8. A portion of the translucent resin film 72 is curved to fit along a surface of the key top 73 so that the translucent resin film 72 is adhered to all surfaces of the key top 73 except a rear surface 73*a*.

A translucent resin film 72 is not limited to specific compositions, kinds, or colors so long as it has translucency. The resin may be appropriately selected to conform to required performance among known synthetic resins and can be formed similarly to the first embodiment.

A symbol layer 75 is disposed on a rear surface 72*a* of a translucent resin film 72 in an area of a press button 74. The symbol layer 75 displays graphical symbols including letters, numbers, symbols, and patterns to be visible from the top of the press button 74 through the translucent resin film 72. The symbol layer 75 is formed by, for instance, applying, printing or transferring ink, or coating on the rear surface 72*a* of the translucent resin film 72. The symbol layer 75 may have an inked-up display, or it may have a cut-out display. The symbol layer 75 may be formed on either a top surface or the rear surface, or both the top and rear surfaces of the translucent resin film 72.

A synthetic resin used for the key top 73 is not limited to specific compositions, kinds, or colors so long as it has translucency. The resin may be appropriately selected to conform to required performance among known synthetic resins, and can be formed similarly to the first embodiment.

Figure 9:
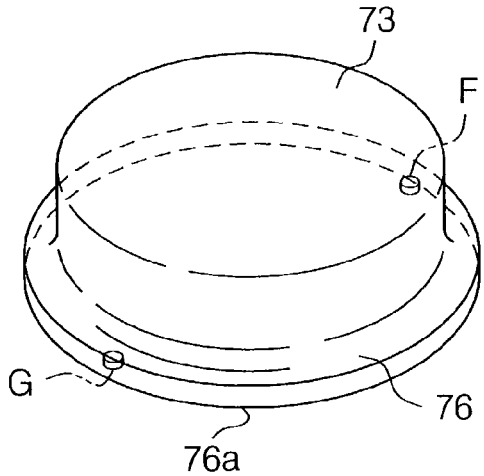
FIG. 9 is a perspective view of a key top comprising a translucent resin in the key sheet according to the second embodiment.

As shown in FIGS. 7 to 9, the key top 73 is formed into a practically cylindrical shape and a projection 76 is provided to project radially outward from the outer surface of the key top. The projection 76 is formed along entire circumference of the outer surface of the key top 73 in a shape of a flange. The rear surface 73*a* of the key top 73 and the rear surface 76*a* of the flange 76 are formed into a continuous smooth surface devoid of any step.

A decorating layer 77 is disposed adjacent to a rear surface 73*a* of the key top 73. The decorating layer 77 may have any colors including red, blue, yellow, green, white, black, and gray, etc., or it may have a metallic color. The decorating layer 77 is visible through the translucent resin film 72 from upper surface of the press button 74. The decorating layer 77 is formed by applying, printing, or transferring ink or a coating, or, evaporating or transferring inorganic substance onto the rear surface 73*a* of the key top 73. Note that the decorating layer 77 may display any graphical symbols including letters, numbers, symbols, and patterns.

The decorating layer 77 preferably has a metallic luster. The decorating layer 77 having such metallic luster can be formed by applying or printing an ink including metallic power (metal ink), or evaporating or transferring metals such as aluminum, chromium, copper, and nickel, etc. Designs with metallic luster can be realized by providing metallic luster to the decorating layer 77. Accordingly, the key sheet 71 is realized with high quality design.

It is preferable that the decorating layer 77 has translucency. The decorating layer 77 can be formed with translucency by applying or printing an ink or a coating having translucency, or by evaporating a metal such as aluminum, chromium, copper, and nickel, etc., into a thickness between 2 to 300 nm. In the case where the decorating layer 77 is formed with translucency, the visibility of the key sheet 71 at night and in the dark places can be improved by disposing an illuminant, such as light emitting diode (LED) and electroluminescence (EL), on the rear surface 73*a* of the key top 73. By evaporating a metal such as aluminum, chromium, copper, and nickel, etc., into a thickness between 5 and 50 nm, the decorating layer 77 can be realized with both metallic luster and translucency.

The flange 76 maybe continuously formed to extend through the entire circumference of the outer side face of the key top 73, or it may be formed discontinuously by cutting a portion of the flange. A stress caused by curving the translucent resin film 72 can be applied uniformly to the translucent resin film 72 when the flange 76 is formed continuously around the side face of the key top 73. Extension of the translucent resin film 72 is thus uniform to improve productivity and the yield so that the high quality key sheet 71 is easily produced. While the thickness of the flange 76 depends on the size and the shape of the key top 73, the thickness is preferably at least 0.2 mm or more from the aspect of formability of the key top 73.

A gate corresponding section G corresponding to a gate of a mold and an air vent corresponding section F corresponded to an air vent of the mold are respectively provided on a rear surface 76*a* of the flange 76. By thus forming the gate corresponding section G and the air vent corresponding section F on the rear surface 76*a* of the flange, the rear surface 73*a* of the key top 73 can be formed into a smooth surface without any steps.

The gate corresponding section G is invisible when observing from the upper surface of the press button 74 in the key sheet 71 of the second embodiment. Accordingly, the gate corresponding section G will not be a cause for degrading visibility of the symbol layer 75. The symbol layer 75 is thus viewed from the upper surface of the press button 74 to produce the key sheet 71 with good appearance. The key sheet 71 can be designed in various ways by disposing symbol layer 75.

The key top 73 is avoided from being formed into a thick film by forming the rear surface 73*a* of the key top 73 into a flat surface without any step. Accordingly, a thin key sheet 71 can be produced unlike the key sheet disclosed in Japanese Laid-Open Patent Publication 8-7698. Further, since the rear surface 73*a* of the key top 73 can be formed into a flat surface without any step, various characters and decorations can be easily disposed on the rear surface 73*a* of the key top 73. Therefore, key sheets 71 with a good appearance can be produced.

Figure 10:
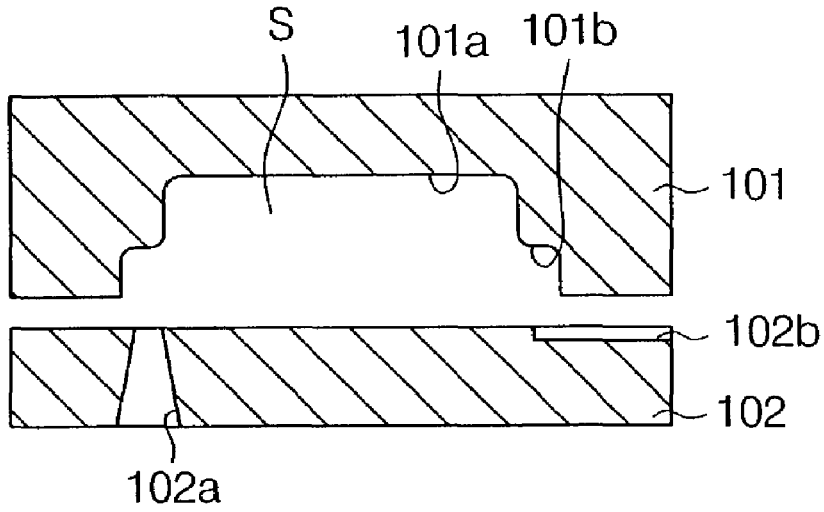
FIG. 10 is a cross sectional view of a mold used for manufacture of a key top of the second embodiment of the invention.

The gate corresponding section G for resin injection and the air vent corresponding section F are respectively positioned in locations to oppose by 180 degrees, with the key top 73 interposed therebetween. Accordingly, gas generated in the cavity S during injection molding of the key top 73 can be efficiently discharged to the outside through the air vent 102*b* (as shown in FIG. 10). The molten synthetic resin can therefore be filled in the cavity S to easily produce a key sheet 71 with a good appearance.

The symbol layer 75 is disposed on the rear surface 72*a* of the translucent resin film 72, and the decorating layer 77 is disposed on the rear surface 73*a* of the key top 73 in the second embodiment. The decorating layer 77 is thus recognized with a three-dimensionally projected appearance, in which shades of the graphics of the symbol layer 75 are projected on the decorating layer 77. A new design, which was not conventionally possible, can be realized so that a key sheet 71 can be realized with a good appearance.

Figure 11:
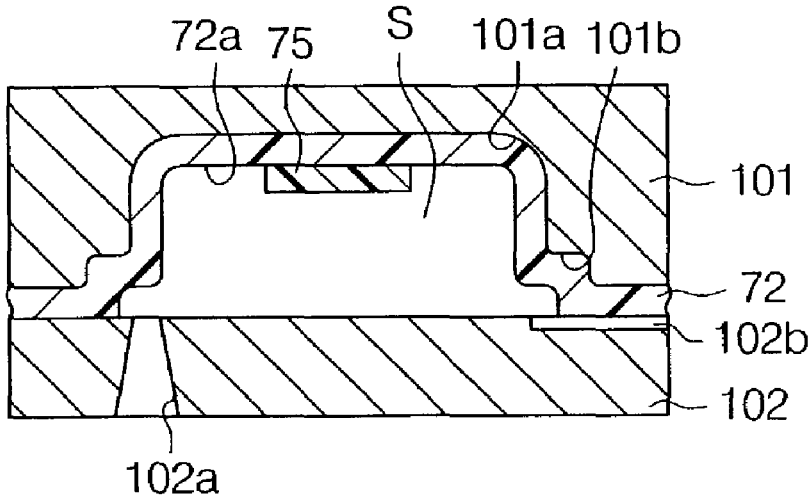
FIG. 11 is a cross sectional view showing one process step of a process for manufacturing a key sheet according to the second embodiment the invention.

The key sheet 71 according to the second embodiment is next described by referring to FIGS. 10 and 11. A manufacturing method using a pair of molds (a first mold 101 and a second mold 102) for molding of the key top 73 is described.

A molding hollow 101*a* (having a practically cylindrical shape for molding the key top 73) and a molding hollow 101*b* (for molding a practically cylindrical shaped flange 76) are arranged to have an identical central axis to define a cylindrical cavity S with a step.

A gate 102*a* for injecting molten resin and an air vent 102*b* are formed in the second mold 102. The gate 102*a* and the air vent 102*b* are respectively disposed in positions to oppose molding hollow 101*b* of the first mold 101, and to oppose each other by interposing the cavity S of the first mold 101.

Though the gate 102*a* is not specifically restricted similarly to the first embodiment, a pinpoint gate is preferable because a trace of gate (gate corresponding section G) that remains on the key top 73 is small. Further, the clearance of the air vent 102*b* is preferably between approximately 0.01 and 0.03 mm.

In manufacture of the key sheet 71, the symbol layer 75 is first formed on the rear surface 72*a* of the translucent resin film 72, and then the translucent resin film 72 is clamped between the first and the second molds 101 and 102. A portion of the translucent resin film 72, which is clamped between the first and the second molds 101 and 102, is preferably curved beforehand to correspond to the profile of the key top 73 which will be formed in the next step (shape of the cavity S of the first mold 101) by using a means, such as a fixture.

Molten synthetic resin is then injected into the cavity S through the gate 102*a* of the second mold 102. The translucent resin film 72 is extended to curve approximately the same shape with the cavity S of the first mold 101 in accordance with the injection of the molten synthetic resin into the cavity S. Here, gas generated in the cavity S during formation of the key top 73 can be discharged to the outside of the cavity S through the air vent 102*b* so that the molten synthetic resin is uniformly filled in the cavity S. As a result, the translucent resin film 72 and the key top 73 are adhered by heat at the same time with the simultaneous formation of the key top 73 and the flange 76 to form the key sheet 71.

The first and the second molds 101 and 102 are then detached after cool to remove the key sheet 71. The key sheet 71 according to the second embodiment is finished by forming the decorating layer 77 on the rear surface 73*a* of the key top 73 of the key sheet. The gate corresponding section G will not shield the field of view when seeing the characters on the decorating layer 77. Accordingly, the decorating layer 77 is clearly visible from the upper surface of the press button 74 of the key sheet 71 to realize a key sheet 71 with a superior appearance. By thus disposing the decorating layer 77, the key sheet 71 can be designed in various ways.

It should be apparent to those skilled in the art that the present invention may be embodied in many other specific forms without departing from the spirit or scope of the invention. Particularly, it should be understood that the invention may be embodied in the following forms.

Figure 14:
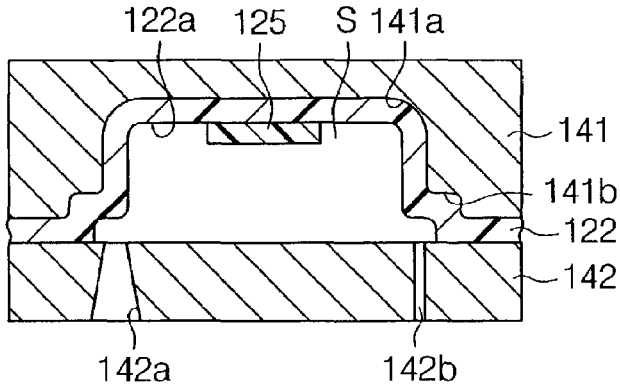
FIG. 14 is a partial cross sectional view showing one process step of a process for manufacturing a key sheet according to another method.
Figure 15:
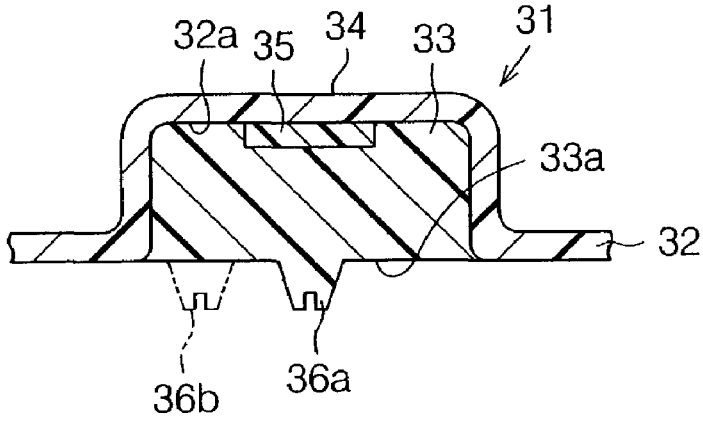
Fig.15 (Prior Art)
FIG. 15 is a partial cross sectional view showing a conventional key sheet.
Figure 16:
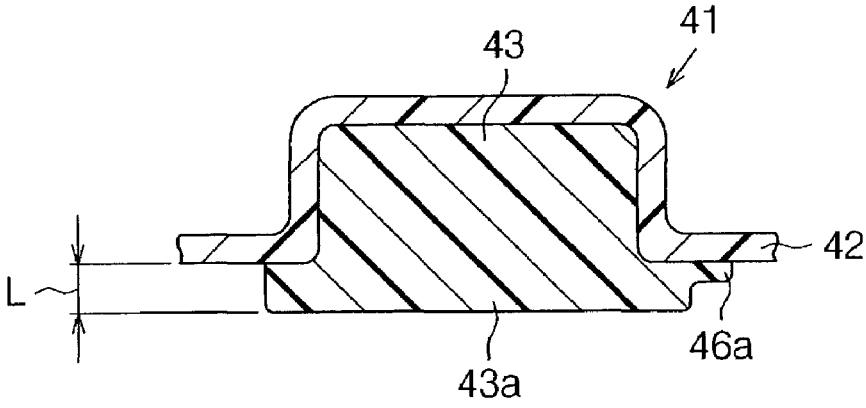
Fig.16 (Prior Art)
FIG. 16 is a partial cross sectional view showing a conventional key sheet.

The shape and the place of the air vent 102*b* can be appropriately altered. For example, an air vent 142*b* can be disposed as shown in FIG. 14.

The shape(s) of the key top 73 and the flange 76, the shape of the molding hollow 101*a* for molding the key top 73, and the shape of the molding hollow 101*b* for forming the flange 76 can be appropriately altered.

Figure 12:
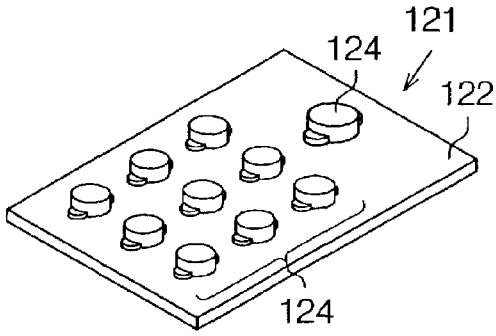
FIG. 12 is a perspective view of a key sheet according to the third embodiment of the invention.
Figure 13:
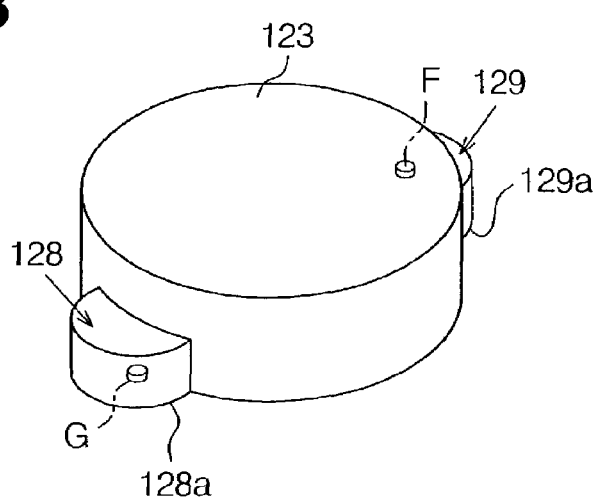
FIG. 13 is a perspective view of a key top comprising a translucent resin in the key sheet according to the third embodiment.

The third embodiment of the invention is next described by referring to FIGS. 12 and 13. Note that only the constitutions peculiar to the third embodiment are described below without repeating the description of common constitutions with the second embodiment.

As shown in FIGS. 12 and 13, projections 128 and 129 having practically cylindrical shape project radially outwardly in lower portions of the outer surface of a practically cylindrical shaped key top 123 in the key sheet 121. The projections 128 and 129 are respectively disposed to oppose by interposing the key top 123. A rear surface 123*a* of the key top 123 and rear surfaces 128*a* and 129*a* of the projections 128 and 129 are formed into a smooth surface without any steps.

A gate corresponding section G of the key top 123 is provided on the rear surface 128*a* of the projection 128. Further, an air vent corresponding section F is provided on the rear surface 129*a* of the projection 129. Accordingly, the gate corresponding section G and the air vent corresponding section F are disposed to oppose each other by interposing the key top 13 also in this embodiment.

As a result, advantages similar to that of the second embodiment is obtained.

EXAMPLES

The second and the third embodiments will be described in more detail by referring to examples. However, the present invention is not limited to the examples described below.

Example 1

A symbol layer 75 illustrating numeric symbols was formed by printing black coating on a rear surface 72*a* of a translucent resin film 72 comprising polyethylene terephthalate. The translucent resin film 72 was then pressed by a fixture and curved, so that the translucent resin film 72 was formed into a shape corresponded to a profile of a key top 73.

The pressed translucent resin film 72 was next clamped between the first mold 101 and the second mold 102 as shown in FIG. 11. A polycarbonate resin was then injected into a cavity S through a gate 102*a* for resin injection of the second mold 102 so as to integrally form the key top 73 and a flange 76 that are shown in FIG. 8. A key sheet 71 was manufactured at the same time as this injection by fusion bond of the translucent resin film 72 and the key top 73.

A decorating layer 77 was formed by printing a white coating on a rear surface 73*a* of the key top 73 to finish the key sheet 71, as shown in FIGS. 8 and 9. The key sheet 71 included the key top 73 with its rear surface 73*a* being a smooth surface without any step, so that the appearance of the key top 73 was superior.

The white decorating layer 77 was visible around the black symbol layer 75 in a press button 74 in the key sheet 71 according to Example 1. Shades of the black symbol layer 75 were projected onto the white decorating layer 77 so that the symbol layer 75 was recognized as projecting in three-dimension.

Example 2

A symbol layer 125 was formed by illustrating a pattern of a telephone by printing a red coating on a rear surface 122*a* of a translucent resin film 122 comprising a polymer alloy material of a polycarbonate resin and a polybutylene terephthalate resin. The translucent resin film 122 was then pressed and curved by a fixture so that the translucent resin film 122 is formed into a shape corresponded to a profile of a key top 123.

The pressed translucent resin film 122 was next clamped between the first mold 141 and the second mold 142 as shown in FIG. 14. A polycarbonate resin was then injected into a cavity S through a gate 142*a* of the second mold 142 as similar to Example 1. At the same time with integral formation of the key top 123 and projections 128 and 129 shown in FIG. 13, a key sheet 121 was manufactured by fusion bond of the translucent resin film 122 and the key top 123. A decorating layer 77 was formed on a rear surface 123*a* of the key top 123 by transferring translucent aluminum foil by hot stamping to form a key sheet 121 shown in FIG. 12. The formed key sheet 121 was provided with a key top 123 with its rear surface 123*a* having a smooth surface without any step. A key top 123 having a superior appearance was thus obtained.

A decorating layer 77 having a silver metallic luster was visible around the red colored symbol layer 125 in the press button 124 in the key sheet 121 of Example 2. Shades of the red symbol layer 125 were projected onto the silver decorating layer 77 so that the symbol layer 125 was recognized as projecting in three-dimension.

Therefore, the present examples and embodiments are to be considered as illustrative and not restrictive and the invention is not to be limited to the details given herein, but may be modified within the scope and equivalence of the appended claims.

What is claimed is:

1. A key sheet comprising:

a key top made of resin, said key top having a top surface and a rear surface, and said key top including a gate corresponding section in a position corresponded to a gate of a mold for injecting resin to form the key top, a translucent resin film provided over the key top, and a symbol layer disposed on the top surface of the key top, wherein the gate corresponding section is located on the rear surface of the key top to prevent the gate corresponding section from being viewed through the symbol layer.

2. A key sheet according to claim 1, further comprising a first decorating layer disposed between the translucent resin film and the key top, wherein the first decorating layer has an opening on the top surface of the key top, and wherein the gate corresponding section is disposed under said first decorating layer.

3. A key sheet according to claim 1, wherein the gate corresponding section is disposed at a position, at which an angle, formed by a horizontal line and a line that extends between an edge of the opening and the gate corresponding section, is 60 degrees or less.

4. A key sheet according to claim 2 further comprising a second decorating layer that is disposed on the rear surface of the key top.

5. A key sheet according to claim 4, wherein at least one of the first and second decorating layers has a metallic luster.

6. A key sheet according to claim 1, further comprising at least one projection extending outwardly from a side face of the key top, wherein a rear surface of the projection and the rear surface of the key top extend along a flat plane, and wherein the gate corresponding section is provided on the rear surface of the projection.

7. A key sheet according to claim 6, wherein the at least one projection is a first projection and a second projection, wherein the first and the second projections are opposed each other.

8. A key sheet according to claim 6, wherein the at least one projection is a flange extending along the entire circumference of the key top.

9. A key sheet according to claim 6, wherein an air vent corresponding section is provided on the rear surface of the at least one projection.

10. A key sheet according to claim 9, wherein the air vent corresponding section is disposed to oppose the gate corresponding section, so that the key top is interposed between the air vent corresponding section and the gate corresponding section.

11. A key sheet according to claim 1, wherein the symbol layer is provided on a rear surface of the translucent resin film.

12. A key sheet comprising:

a key top made of resin, said key top having a top surface and a rear surface, and said key top including a gate corresponding section in a position corresponded to a gate for injecting resin of a mold used for forming the key top, a translucent resin film provided over the key top, a symbol layer disposed on the top surface of the key top, and a first decorating layer disposed between the translucent resin film and the key top, wherein the first decorating layer has an opening on the top surface of the key top to dispose the symbol layer associated with the key top, wherein the gate corresponding section is located under said first decorating layer to prevent the gate corresponding section from being viewed through the symbol layer.

13. A key sheet according to claim 12, wherein the gate corresponding section is disposed at a position, at which an angle, formed by a horizontal line and a line that extends between an edge of the opening and the gate corresponding section, is 60 degrees or less.

14. A key sheet according to claim 12, further comprising a second decorating layer that is disposed on the rear surface of the key top.

15. A key sheet according to claim 14, wherein at least one of the first and second decorating layers has a metallic luster.

16. A key sheet according to claim 12, wherein the symbol layer is provided on a rear surface of the translucent resin film.

17. A key sheet comprising:

a key top made of resin, said key top having a top surface and a rear surface, and said key top including a gate corresponding section in a position corresponded to a gate of a mold for injecting resin to form the key top, a translucent resin film provided to cover the key top, a symbol layer disposed on a surface of the translucent resin film in an area over the top surface of the key top, and a reinforcing layer disposed between the translucent resin film and the key top, to be disposed on a rear side of the symbol layer, wherein the gate corresponding section is located on the rear surface of the key top to prevent the gate corresponding section from being viewed through the symbol layer.

18. A key sheet according to claim 16 further comprising a first decorating layer disposed between the translucent resin film and the key top with an opening located over the top surface of the key top, wherein the symbol layer is provided within said opening.

19. A key sheet according to claim 16, wherein the gate corresponding section is disposed at a position, at which an angle, formed by a horizontal line and a line that extends between an edge of the opening and the gate corresponding section, is 60 degrees or less.

20. A key sheet according to claim 16, further comprising a second decorating layer that is disposed on the rear surface of the key top.

21. A key sheet according to claim 16, wherein at least one of the first and second decorating layers has a metallic luster.

* * * * *